United States Patent [19]

Eck

[11] Patent Number: 5,051,139

[45] Date of Patent: Sep. 24, 1991

[54] PROCESS FOR THE MANUFACTURE OF SEMI-FINISHED PRODUCTS OR PREFORMED PARTS MADE OF REFRACTORY METALS AND RESISTANT TO THERMAL CREEP

[75] Inventor: Ralf Eck, Reutte/Tirol, Austria

[73] Assignee: Schwarzkopf Development Corporation, New York, N.Y.

[21] Appl. No.: 517,291

[22] Filed: May 1, 1990

[30] Foreign Application Priority Data

May 3, 1989 [AT] Austria ..... 1059/89

[51] Int. Cl.[5] ..... C22C 27/04; H01K 1/38

[52] U.S. Cl. ..... 148/11.5 F; 148/12.7 B; 148/422; 148/423; 420/429; 420/431

[58] Field of Search ..... 148/11.5 F, 12.7 B, 148/422, 423; 420/429, 431

[56] References Cited

U.S. PATENT DOCUMENTS

| | | | |
|---|---|---|---|
| 4,165,982 | 8/1979 | Tatsuo et al. | 420/429 |
| 4,375,375 | 3/1983 | Giamei et al. | 148/11.5 F |
| 4,430,296 | 2/1984 | Koizumi et al. | 420/429 |
| 4,657,735 | 4/1987 | Whelan et al. | 148/407 |
| 4,755,712 | 7/1988 | Mujahid et al. | 420/429 |
| 4,768,365 | 9/1988 | Spencer et al. | 148/11.5 F |

FOREIGN PATENT DOCUMENTS

| | | | |
|---|---|---|---|
| 0080745 | 5/1984 | Japan | 420/429 |
| 1023741 | 2/1986 | Japan | 420/429 |

*Primary Examiner*—Upendra Roy
*Attorney, Agent, or Firm*—Morgan & Finnegan

[57] ABSTRACT

A process for the manufacture of dispersion-strengthened alloys of the refractory metals of the 4th, 5th and 6th subgroups of the Periodic Table for application in semi-finished products or preformed parts requiring high thermal creep-resistances, involves integrating dispersion-strengthening into the process in 2–4 partial operational steps through thermal reshaping, utilizing only 3–25% strain per partial step. Annealing processes are implemented between the individual reshaping processes at temperatures, which at least during some part of the annealing process, are below the respective recrystallization temperatures of the alloy materials. The maximum deformation of the alloy materials is 75%, but is normally substantially lower. Components manufactured from the materials produced according to the process include tools used in isothermic high-temperature forging or in rotating anode X-ray tubes.

12 Claims, No Drawings

PROCESS FOR THE MANUFACTURE OF SEMI-FINISHED PRODUCTS OR PREFORMED PARTS MADE OF REFRACTORY METALS AND RESISTANT TO THERMAL CREEP

BACKGROUND OF THE INVENTION

The invention relates to a process for the manufacture of semi-finished products or preformed parts each having high thermal creep-resistance and each made from sintered or molten fabricated materials of dispersion-strengthened alloys. The alloy materials are made up of the refractory metals vanadium, niobium, tantalum, chromium, molybdenum, and tungsten, either alone, or in combination with one another, or as a major constituent with other metal components.

For semi-finished products, and in particular for preformed parts made of refractory metals, there is a need for improved thermal stability characteristics, primarily higher resistance to thermal creep. The stability characteristics of such metals can be achieved by alloying, deformation strengthening, age-hardening processes, and dispersion hardening. Among the processes for the manufacture of creep-resistant alloys, doping and reshaping have proven quite effective in creating a stacking structure in the metal, that is, a structure in which the individual metal crystals exhibit a minimum aspect ratio of 1:2.

For a long period of time, refractory metals were doped primarily with potassium, aluminum, and silicon for this purpose. In recent years, doping with oxide-and carbide-based dispersoids has acquired increased significance. Such alloys are described, for example, in Austrian Patent Specification 386 612.

Of the processes known in the art for the manufacture of materials resistant to thermal creep, thermal reshaping, which is implemented by immediately successive and the largest reshaping steps possible at very high deformation strains, i.e., 90% and more, yields the best thermal creep-resistance values. During this process, the reshaped materials are subjected to final recrystallization annealing to form as distinct a stacking structure as possible. Those processes which involve multiple reshaping steps and annealing operations are complex and expensive, but according to prevailing technical wisdom are unavoidable in order to achieve optimum thermal creep-resistances.

Alternatively, thermal reshaping with up to 60–90% deformation, is achieved in a single operation with intermediate heating of the workpiece, if necessary. If, for example, the reshaping process cannot be implemented to the desired degree of deformation, or the alloy cannot be reshaped quickly enough to the desired shape without cooling off to an excessive degree, then the thermal creep-resistance values of the alloys fabricated in this manner are markedly lower than those values achieved when a stacking structure is formed.

OBJECTS OF THE INVENTION

It is therefore an object of the present invention to devise an improved method for the manufacture of dispersion-strengthened semi-finished products or preformed parts from refractory metals and alloys, in which the improved process is distinguished from other conventional processes by a smaller number of procedural steps, as well as by higher economic efficiency.

Another object of the invention is to provide a process which is similarly intended to produce higher temperature stability values, even at temperature values at and above 75% of the melting temperature of the primary constituent of the alloy, than are currently provided by those materials and methods known in the art.

Still another object is to provide a method which will impart high thermal creep-resistance values to semi-finished products or preformed parts made from refractory alloys.

A further object of the invention is to provide semi-finished and preformed parts manufactured according to the improved process.

SUMMARY OF THE INVENTION

These and other objects are achieved by a process for the manufacture of semi-finished products or preformed parts each with high thermal creep-resistance and each made from sintered or molten fabricated materials of dispersion strengthened alloys. The alloys are made up of at least one of the refractory metals selected from the group consisting of the primary metal constituents of vanadium, niobium, tantalum, chromium, molybdenum, and tungsten, and combinations thereof, alone or with other metal components. The process involves thermomechanically deforming the fabricated materials about two to about four times in succession employing a strain of approximately 3–25% each time such that the overall strain does not exceed about 75%. This thermomechanical deforming is effected at hot forming temperatures in the range of about 900° C. to about 1600° C., customary for the respective primary metal constituent. The above process is alternated by subjecting the fabricated materials to intermediate annealing for about 1 to 6 hours at temperatures between the respective hot forming temperature and the respective recrystallization temperature for the primary metal constituent.

The process for the manufacture of the semi-finished products described above can further involve implementing at least one, or all the intermediate annealing operations in two steps. The first partial step occurs for a period of time equal to approximately half the total annealing time and at a temperature of about 1300° C. to about 2100° C., which temperature is above the recrystallization temperature of the respective primary metal constituent. The second partial step occurs at the hot forming temperature of the metal constituent for a period of time equal to approximately the other half of the total annealing time.

Also provided as part of the invention are forging or pressing tools used in high-temperature reshaping of metallic molded parts, as well as rotating anode X-ray tubes which have been manufactured from the dispersion-strengthened alloys produced according to the above-described processes.

DETAILED DESCRIPTION OF THE PREFERRED EMBODIMENTS

The process according to the present invention, in which sintered or molten fabricated materials made from the materials stated at the outset are processed to semi-finished products, involves thermo-mechanically deforming or reshaping the fabricated materials about 2 to 4 times in succession employing a strain of approximately 3–25%, respectively, but which strain overall does not exceed about 75%, at hot forming temperatures in the range of about 900° to about 1600° customary for the respective primary metal constituent of the alloy in the fabricated material which makes up the semi-finished product or pre-formed part. Preferably, the hot forming temperature is in the range of about 1250 degrees C. to about 1350 degrees C. In between the deforming operations the fabricated materials are subjected to intermediate annealing for about 1 to 6 hours.

In one embodiment of the invention, the temperature at which intermediate annealing takes place is between the respective hot forming temperature and the respective recrystallization temperature for the primary metal constituent. In a preferred embodiment, the intermediate annealing operation is implemented in two partial steps. The first step occurs for a period of time equal to approximately half the total annealing time at a temperature of about 1300 degrees C. to about 2100 degrees C., which temperature is above the recrystallization temperature of the metal constituent. The second partial step occurs at the respective hot forming temperature for a period of time equal to approximately half the total annealing time.

The term semi-finished products should be understood to mean, for example, forging blanks, rods, circular blanks, sheet metal, and wires. Preformed parts, in contrast thereto, are those parts which are manufactured from semi-finished products through molding processes, like machining, but which do not further affect metallic structure and metallic properties. Additionally, they are those parts which in the course of thermal reshaping are processed simultaneously from fabricated materials into application-ready preformed parts.

The most important alloying elements used in accordance with the invention in addition to the primary constituent metals specified hereinbefore, are the metals of the 4th Subgroup of the Periodic Table. Also employed are those other elements currently being utilized in alloys, especially rhenium and platinum.

Among the dispersoids for refractory metals there are the oxides, and especially the oxides of the rare earth metals. Preferred oxides include cerium oxide, yttrium oxide, and lanthanum oxide. Especially preferred are thorium oxide, manganous oxide, titanium oxide, and zirconium oxide. In addition, carbides, silicides, borides, and nitrides have been successfully used as dispersoids in refractory metals. In a preferred embodiment of the invention, the dispersoids are carbide or oxide-based, or both. Because of their known drawbacks at very high application temperatures, alkaline earth metals, aluminum and silicates are much less preferred for use in accordance with the present invention, but should not be completely excluded.

The term "customary hot forming temperatures" should be understood to mean those temperatures which, as regards the respective refractory metal, advantageously find application in thermal deforming or reshaping effected by forging and/or swaging. In this context a qualitatively high-grade, e.g., flawless, output is as much a criterion as is the economic efficiency of the process. In regard to chromium for example, whose melting temperature is commensurately lower, the most advantageous temperature is obviously markedly lower than that for tungsten but is, in any event, below that temperature at which recrystallization of the chromium occurs. The strain coefficients to be applied per reshaping operation are to be limited to the range of critical deformation, that is, to that range during which as a result of the subsequent thermal processing, granular growth occurs.

Extrusion molding and drawing methods should also be mentioned as additional thermal or hot deformation processes which are readily adaptable to the process of the present invention.

Considering the known state of the art, it is completely surprising to discover that deformation, in small percentage gradations and up to a maximum of 75%, and normally substantially less, in conjunction with the aforementioned intermediate annealing procedures, results in extremely favorable thermal creep-resistance values for the semi-finished products or preformed parts. It was previously known that in order to achieve the highest thermal creep-resistance values possible using the aforementioned materials, a minimum deformation of 90%, and often times considerably more, was required.

It is similarly surprising and unforeseeable that refractory alloys manufactured according to the present invention do not necessarily have to be processed to the point where they form a stacking structure. In other words, higher thermal creep-resistance values than those previously known in the art can nevertheless be achieved when compared with comparable refractory alloys with a stacking structure.

This fact notwithstanding, peak values with respect to thermal stability, and to thermal creep-resistance values in particular, were achieved for individual alloys of refractory metals when, in a modification of the basic process according to the invention, intermediate annealing was initiated subsequent to the individual reshaping steps. For example, during the first half of the total annealing time contemplated, the intermediate annealing is carried out at temperatures above the recrystallization temperature of the respective material or primary metal constituent, that is, at about 1300° C. to about 2100° C. During the second half of the annealing period, the annealing takes place at the hot forming temperature of the metal constituent, which temperature lies fundamentally below the recrystallization temperature. By means of this two-part intermediate annealing process, and in contrast to uniform intermediate annealing, staking structures can be achieved which again substantially increase the thermal creep-resistance values of the corresponding materials.

An important advantage of the refractory alloys manufactured in accordance with the process of the invention lies in the high thermal creep-resistance values achieved even in temperature ranges lying at three-quarters of the respective melting temperature of the metal constituent. In comparison, thermal creep-resistant alloys manufactured in accordance with other processes begin to attenuate heavily at corresponding values. A further advantage of the process according to the invention lies in the fact that in addition to thermal creep-resistance values, other thermal stability values and specifically tensile strength with adequate residual elongation, are comparably favorable.

The dispersion-strengthened alloys manufactured in accordance with the process of the present invention preferably find application in forging or pressing tools used in high temperature shaping of metallic molded parts, especially in isothermic high-temperature forging. Rotating anode x-ray tubes are another area of application.

Of the high-temperature metal alloys which possess high thermal creep-resistance characteristics, molybdenum alloys admixed with zirconium, hafnium and some carbon had heretofore revealed particularly favorable thermal stability characteristics. These alloys are known in the art as ZHM-alloys and constitute an advance over molybdenum alloys known in the art as TZM-alloys. The Table which follows impressively documents that oxide-dispersion-strengthened ZHM-alloys, manufactured according to the process of the present invention, achieve markedly better thermal creep-resistance values than ZHM alloys manufactured in accordance with processes customarily utilized heretofore in the art.

The ZHM-molybdenum alloy used for comparison purposes was brought to the same degree of overall deformation of approximately 70%. However, this deformation was achieved in a single operation, without intermediate annealing on the basis of the small deformation graduations in accordance with the invention.

The corresponding TZM-molybdenum alloy, which with respect to its high thermal creep-resistance was long regarded as the leading alloy for the purpose, could not even be utilized for comparison purposes inasmuch as an equivalent test, at the loading resistance values stated in the following Table, would have failed in less than a minute. The Table and Examples are illustrative of the invention, and in no way should be construed as limiting.

TABLE

| Alloy | Results of Process | State of the art (for comparison) |
|---|---|---|
| 1. Linear creep velocity at 1100° C. 450 N/mm² in h-1 | | |
| ZHM, 1 $CeO_2$ (Example 1) | $<10^{-5}$ | |
| ZHM, 1 $Y_2O_3$ (Example 2) | $<10^{-5}$ | |
| ZHM | | $2 \times 10^{-3}$ |
| 2. Thermal tensile resistance at 1450° C. in a vacuum with 5 mm/min in N/mm² test velocity | | |
| ZHM, 1 $CeO_2$ (Example 1) | 490 | |
| ZHM, 1 $Y_2O_3$ (Example 2) | 520 | |
| ZHM | | 210 |
| TZM | | 60–80 |
| ZHM = Mo; 1.2 Hf; 0.4 Zr; 0.15 C | | |

EXAMPLE 1

Molybdenum metal powder, consisting of 5 μm-size grains, was mixed with fine-granular powder alloys having a grain size of approximately 0.8 μm, specifically with 1.2% wt. Hf, 0.4% wt. Zr, 0.15% wt. C, and 1.0% wt. $CeO_2$; the mixture was poured into a rubber tube, vigorously vibrated and compacted cold-isostatically under water at a pressure of 2500 bar. The isostatically compacted rod was formed green to a diameter of 75 mm and thereafter cut to a length of 55 mm. The cylinders were sintered for 5 hours at 2000° C. in a dry $H_2$ atmosphere (TP $< -35°$ C.). Sintering compaction density was 9.50 g/cm³. The reshaping operation comprised the preheating of the sintered blank to 1200° C. in a furnace flooded with $H_2$ for 20 minutes; further, swaging to a height of 43 mm, dual-periodic annealing, initially for 1 hour at 2000° C. and, subsequently, for 1 hour at 1500° C. Thereafter, the sintered blank was heated in a forging furnace to a temperature of 1200° for 20 minutes and forged at 10% strain to a height of 39 mm. Annealing and forging operations were repeated two more times: annealing at 2000° C., for 1 hour, and 1500° C., for 1 hour, preheating for 20 minutes to 1200° C., and final forging to a height of 12 mm.

The samples manufactured in this manner were analyzed to determine their thermal stability characteristics. The test results are presented in the table. The samples displayed a linear creep velocity of less than $10^{-5}$, and a thermal tensile resistance of 490.

EXAMPLE 2

The procedure according to Example 1 was repeated, With the following alloy constituents: Mo—1.2% wt. Hf, 0.4% wt. Zr, 0.15% wt. C, and in departure from Example 1, 1 % wt. $Y_2O_3$, with a grain size of 0.25 μm. The samples displayed a linear creep velocity of less than $10^{-5}$, and a thermal tensile resistance of 520.

EXAMPLE 3

Tungsten metal powder, extracted through $H_2$ reduction of blue tungstic oxide and exhibiting a grain size of 3.80 μm, was mixed together in a positive mixer with 1.2% wt. Hf, 0.40 % wt. Zr, 0.10% wt. C, and 1.0% wt. $CeO_2$, and having a granular size of approximately 0.8 μm. The mixture was then compacted in a master compression mould die with a 105—mm diameter, to a height of 55 mm. The circular blanks were sintered for 7 hours at 2500° C. in dry $H_2$ having a $-35°$ C. condensation point, thereby achieving a density of 17.7 g/cm₃. Following sintering, the dimensions of the circular blanks were: diameter—90 mm, and height—48 mm, approximately.

The circular blanks were initially preheated for 20 minutes to a temperature of 1550° C. and thereupon hot-forged to a height of 43 mm. The circular blanks were then annealed for 2 hours at 1550° C. in an $H_2$ atmosphere, whereupon the circular blanks were again preheated for 20 minutes at a temperature of 1550° C. and, in a second forging operation at this temperature and at 10% strain, deformed to a height of 39 mm. Subsequent annealing was again performed at 1550° C. for 2 hours in an $H_2$ atmosphere. For the third forging operation, the circular blanks were again preheated to a temperature of 1550° C. for 20 minutes and then forged to a height of 35 mm. Finally, the circular blanks were annealed for a fourth time at 1550° C. and following a final preheating over a 20-minute period to 1550° C., finish-forged to a height of 17 mm and cooled down over night from the forging temperature to ambient temperature.

The samples manufactured in this manner were analyzed and revealed, at 1600° C., creep characteristics which surpassed, to an approximate power of 10, those creep-resistance characteristics of T-alloys manufactured in a single forging operation.

It is to be understood that the foregoing description is illustrative only and that numerous changes can be made in the described embodiments without departure from the spirit of the invention as set forth in the accompanying claims.

What is claimed is:

1. A process for the manufacture of semi-finished products or preformed parts each with high thermal creep-resistance and each made from sintered or molten fabricated materials of dispersion strengthened alloys, said alloys being comprised of at least one of the refractory metals selected from the group consisting of a primary metal constituent of vanadium, niobium, tantalum, chromium, molybdenum, and tungsten, and combinations thereof, alone or with other metal components, comprising thermo-mechanically deforming said fabricated materials about two to about four times in succession employing a strain of about 3–25% each time such that the overall strain does not exceed about 75%, said deforming being effected at hot forming temperatures in the range of about 900° C. to about 1600° C. customary for the said respective primary metal constituent, said process being alternated by an intermediate annealing operation for about 1 to 6 hours at temperatures between the respective hot forming temperature and the respective recrystallization temperature for the said primary metal constituent.

2. A process for the manufacture of semi-finished products as claimed in claim I, wherein at least one of said intermediate annealing operations is implemented in two partial steps such that the first partial step occurs for a period of time equal to approximately half the total annealing time and at a temperature of about 1300° C. to about 2100° C., said temperature being above the recrystallization temperature of said metal constituent, and wherein the second partial step occurs at the said hot forming temperature for a period of time equal to approximately the other half of the total annealing time.

3. A process for the manufacture of semi-finished products as claimed in claim 1, wherein said deforming is effected by hot forging.

4. A process for the manufacture of semi-finished products as claimed in claim 1, wherein said dispersion strengthened alloys further comprise oxide- or carbide-based dispersoids, or both.

5. Forging or pressing tools used in high-temperature reshaping of metallic molded parts made from an alloy manufactured in accordance with claim 1.

6. Rotating anodes for X-ray tubes made from an alloy manufactured in accordance with claim 1.

7. A process for the manufacture of semi-finished products as claimed in claim 2, wherein said dispersion strengthened alloys further comprise oxide- or carbide-based dispersoids, or both.

8. A process for the manufacture of semi-finished products as claimed in claim 4, wherein said oxide-based dispersoids are at least one selected from the group consisting of $CeO_2$, $Y_2O_3$, $La_2O_3$ and $ThO_2$.

9. A process for the manufacture of semi-finished products as claimed in claim 4, wherein said alloy is a molybdenum alloy admixed with zirconium, hafnium, and finely distributed oxide and carbide-based dispersoids.

10. A process for the manufacture of semi-finished products as claimed in claim 8, wherein said oxide-based dispersoids are at least one selected from the group consisting of $CeO_2$, $Y_2O_3$, $La_2O_3$ and $ThO_2$.

11. A process for the manufacture of semi-finished products as claimed in claim 9, wherein said deforming is implemented at temperatures between about 1250° C. and about 1350° C.

12. A process for the manufacture of semi-finished products as claimed in claim 10, wherein said alloy is a molybdenum alloy admixed with zirconium, hafnium, and finely distributed oxide and carbide-based dispersoids.

* * * * *

UNITED STATES PATENT AND TRADEMARK OFFICE

CERTIFICATE OF CORRECTION

PATENT NO. : 5,051,139

DATED : September 24, 1991

INVENTOR(S) : Ralf Eck

It is certified that error appears in the above-identified patent and that said Letters Patent is hereby corrected as shown below:

On the title page, under item [56] References Cited, please add the following:

-- U.S. PATENT DOCUMENTS 4,514,234 4/1985 Fukasawa et al. .....148/11.5F

FOREIGN PATENT DOCUMENTS 1,064,056 4/1967 Great Britain 0,313,484 4/1989 European Patent Office 2,751,623 Fed. Rep. of Germany 1,079,844 Fed. Rep. of Germany 143,565 Fed. Rep. of Germany --.

Col. 7, (claim 2) line 9, "claim I" should be --claim 1--.

Col. 8, (claim 10) line 17, "claim 8" should be --claim 7--.

Signed and Sealed this

Twenty-fifth Day of May, 1993

*Attest:*

*Attesting Officer*

Michael K. Kirk

MICHAEL K. KIRK

*Acting Commissioner of Patents and Trademarks*